United States Patent [19]

Matsumoto Yoshiaki et al.

[11] Patent Number: 4,695,814

[45] Date of Patent: Sep. 22, 1987

[54] CIRCUIT BREAKER

[75] Inventors: Matsumoto Yoshiaki; Shinji Yamagata; Kazuyoshi Sugihara, all of Fukuyama, Japan

[73] Assignee: Mitsubishi Denki Kabushiki Kaisha, Tokyo, Japan

[21] Appl. No.: 870,326

[22] Filed: Jun. 3, 1986

[30] Foreign Application Priority Data

Jun. 27, 1985 [JP] Japan ..... 60-97958[U]

[51] Int. Cl.[4] ..... H01H 71/16; H01H 75/08

[52] U.S. Cl. ..... 337/77; 337/75; 335/43

[58] Field of Search ..... 337/77, 75; 335/43

[56] References Cited

U.S. PATENT DOCUMENTS 2,657,292 10/1953 Page ..... 337/77

3,313,898 4/1967 Owen ..... 337/77

*Primary Examiner*—Harold Broome

*Attorney, Agent, or Firm*—Lowe Price LeBlanc Becker & Shur

[57] ABSTRACT

A circuit breaker having a thermal tripping device comprising a bimetal element and a heater has a holding member attached to the stationary part of the bimetal element, for holding the bimetal element and the heater at respective first end parts thereof. The holding member has an arm connected to a flexible copper wire and generates heat when an over-current flows through it, the arm conducting this heat to the attached end part of the bimetal element to cause the bimetal element to bend and deflect a second end thereof to provide circuit breaking action.

4 Claims, 7 Drawing Figures

CIRCUIT BREAKER

FIELD OF THE INVENTION AND RELATED ART STATEMENT

1. Field of the Invention

The present invention relates generally to a circuit breaker, and more particularly to a circuit breaker having a heat holding generating member for holding bimetal element and a separate heater.

2. Description of the Related Art

A configuration of a conventional circuit breaker 1 is shown in FIG. 4. The casing of the circuit breaker comprises a base 1*a* and a cover 1*b*. A movable contact 4 is moved by a handle 2 through an operating mechanism 3. An automatic tripping device is formed by a thermal tripping device 10 using a bimetal element 10*a* and a heater 10*b* and a magnetic tripping device 12. A trip bar 8 is disposed near the bimetal 10*a* and is moved by a screw 16 disposed at a free end 10*e* of the bimetal element 10*a* or a plunger (not shown in FIG. 4) of a magnetic tripping device 12. The bimetal element 10*a* and heater 10*b* are fixed on a junction part 11*a* of a L-shaped holding member 11 which is made of copper, and the holding member 11 is fixed on the base 1*a*. One end 13*a* of a flexible copper wire 13 is connected to the holding member 11 at the junction part 11*a* whereon both the bimetal element and the heater are fixed. The opposite end 13*b* of the flexible copper wire 13 is connected to the movable contact 4. A coil 14 of the magnetic tripping device 12 is connected between a terminal conductor 9 and an end part 10*c* of the heater 10*b*.

When an overcurrent flows through the circuit breaker, the bimetal element 10*a* is heated by the heater 10*b* and deflects, whereby the trip bar 8 is moved by the screw 16 of the bimetal 10*a*, and the movable contact 4 is made to open through the operating mechanism 3. On the other hand, when very large overcurrent flows through the circuit breaker, a plunger (not shown in FIG. 4) which is driven by the magnetic force of the magnetic tripping device 12 moves the trip bar 8, whereby the movable contact 4 is also made to open.

The detailed configuration of the junction part 11*a* is shown in FIG. 5 and a cross section at a line VI—VI is shown in FIG. 6. One end 13*a* of the flexible copper wire 13 is fixed on a surface 11*b* of the holding member 11. When the current flows between the flexible copper wire 13 and the heater 10 through the junction part 11*a* and the bimetal element 10*a*, a little heat is generated at the junction part 11*a* since the distance between the end 13*c* of the flexible copper wire 13 and the junction part 11*a* is short and a resistance between them is very low. Therefore, the bimetal element 10*a* is heated only by the heater 10*b*. In the above-mentioned conventional circuit breaker a relatively large heater is required to heat the bimetal element, the cost of fabricating it is significant. Furthermore, since the bimetal element is heated by radiated heat from the heater, the temperature of the bimetal element is unstable, and the adjustment of the automatic tripping device is not easy.

Another embodiment of a circuit breaker in the prior art is shown in the U.S. Pat. No. 4,105,986. This circuit breaker has a bimetal trip actuator. The bimetal trip actuator includes a planar bimetal element held relatively stationary at one end, with its other end set free in response to overload current conditions through the circuit breaker. A plain view of the bimetal portion 44 thereof is shown in FIG. 7. The bimetal portion 44 has a narrower portion 43 formed towards the supported end thereof and a relatively wider portion 45 formed towards the deflecting end thereof. By using the same bimetal thickness, when current flows in the bimetal portion, heat is concentrated in the narower portion 43 of the bimetal. Hence the required deflection of the bimetal portion is obtained by a smaller power dissipation than that of a bimetal element having a uniform distribution of heat along the bimetal. Such a bimetal trip actuator the prior art is suitable for use in a small type circuit breaker because the current flows through the bimetal itself.

SUMMARY OF THE INVENTION

It is an object of the present invention to supply a sufficient heat for deflection to a bimetal element in a circuit breaker. In accordance with the present invention, the bimetal element is heated by a heater and is also heated by heat which is generated at a junction part of a holding member due to a current flowing therethrough.

A circuit breaker in accordance with the present invention comprises:

- a thermal tripping device having a bimetal element and a heater,
- a holding member for holding the bimetal element and the heater at respective first end parts thereof,
- an arm disposed on the holding member for generating heat by flowing of over-current therethrough and conducting heat to the first end part of the bimetal, and
- a flexible copper wire fixed on the arm for flowing current therethrough.

In the present invention the flexible copper wire is fixed on the arm of the holding member, and a current path in the holding member is prolonged. When the current flows through the arm, heat is generated in the arm. Hence the bimetal is heated by both the heat sources of the heater and the arm. As a result, the heater to be used may be made smaller in size, and hence less expensive, than that of the prior art.

DESCRIPTION OF THE PREFERRED EMBODIMENT

Figure 1:
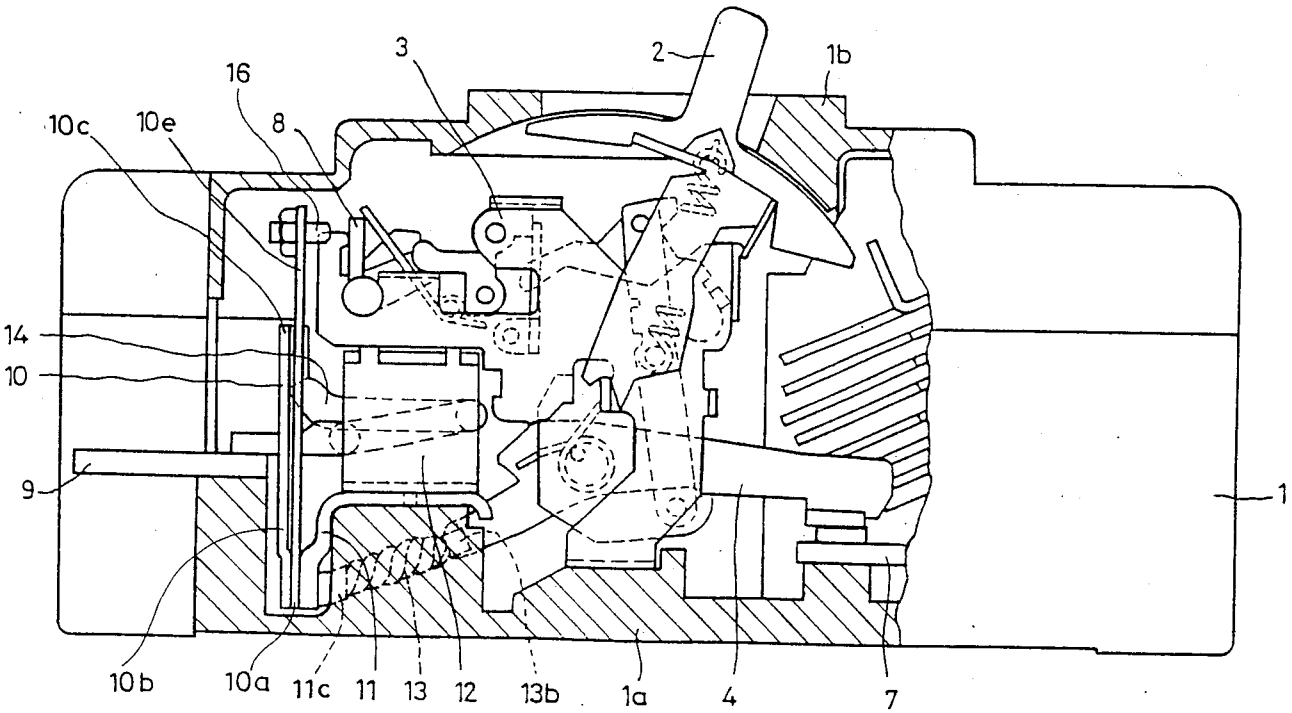
FIG. 1 is a cross-sectional view of an embodiment of a circuit breaker in accordance with the present invention.

An embodiment of a circuit breaker in accordance with the present invention is shown in FIG. 1. The casing of the circuit breaker comprises a base 1*a* and a cover 1*b*. A movable contact 4 which contacts a stationary contact 7 is operated by a handle 2 through an operating mechanism 3. An automatic tripping device is formed by a thermal tripping mechanism 10 using a bimetal element 10*a* and a well-known magnetic tripping device 12. A trip bar 8 which drives the operating mechanism 3 and makes the circuit breaker trip is disposed adjacent to a free end 10*e* of the bimetal element 10*a*. The bimetal element 10*a* has a screw 16 at a free end 10*e* thereof, and a trip bar 8 is pushed by screw 16 when the circuit breaker trips. The bimetal element 10*a* and a heater 10*b* are affixed to a junction part 11*a* of an L-shaped holding member 11 which is made of, for example, CrCu, Bs, steel or the like having a higher resistance than copper, and the holding member 11 is fixed on the base 1*a*. One end 13*a* of a flexible copper wire 13 is connected to the holding member 11 at the junction part 11*a* whereon both the bimetal element and the heater are affixed. The opposite end 13*b* of the flexible copper wire 13 is connected to the movable contact 4. A coil 14 of a known magnetic tripping device 12 is connected between a terminal conductor 9 and an end part 10*c* of the heater 10*b*. Therefore current flows through a stationary contact 7, the movable contact 4, the flexible copper wire 13, the arm 11*c*, the heater 10*b*, the coil 14 and the terminal conductor 9.

When an overcurrent flows through the circuit breaker, the bimetal element 10*a* is heated by the heater 10*b* and deflects, whereby the trip bar 8 is pushed by the screw 16, the trip bar 8 drives the operating mechanism 3 and the movable contact 4 is made to open. On the other hand, when a very large overcurrent flows through the circuit breaker, the known magnetic tripping device 12 acts and rapidly drives the trip bar 8 whereby and the movable contact 4 is made open in a similar manner.

Figure 2:
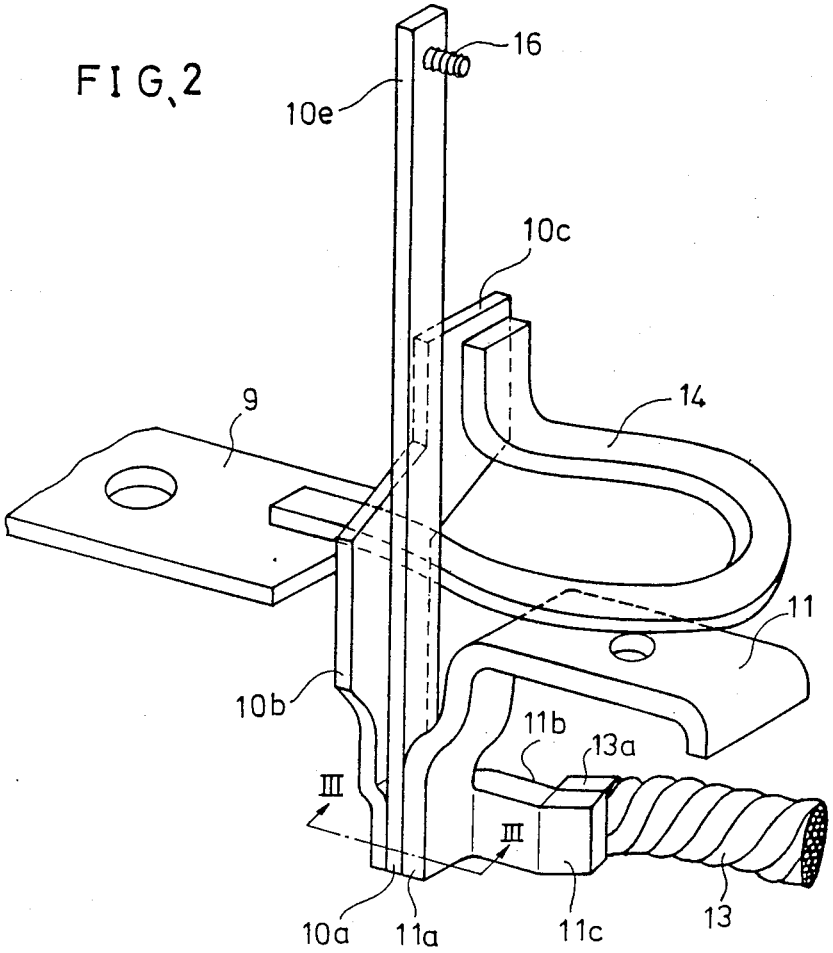
FIG. 2 is a perspective view of an embodiment of a thermal tripping device in accordance with the present invention.
Figure 3:
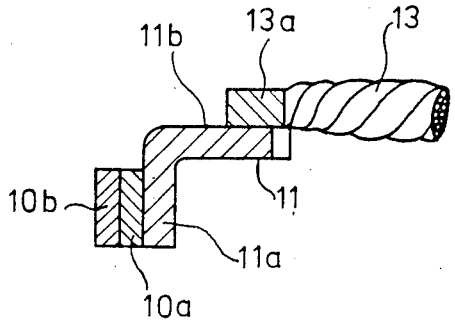
FIG. 3 is a cross-sectional view by a line III—III of the thermal tripping device as shown in FIG. 2.
Figure 4:
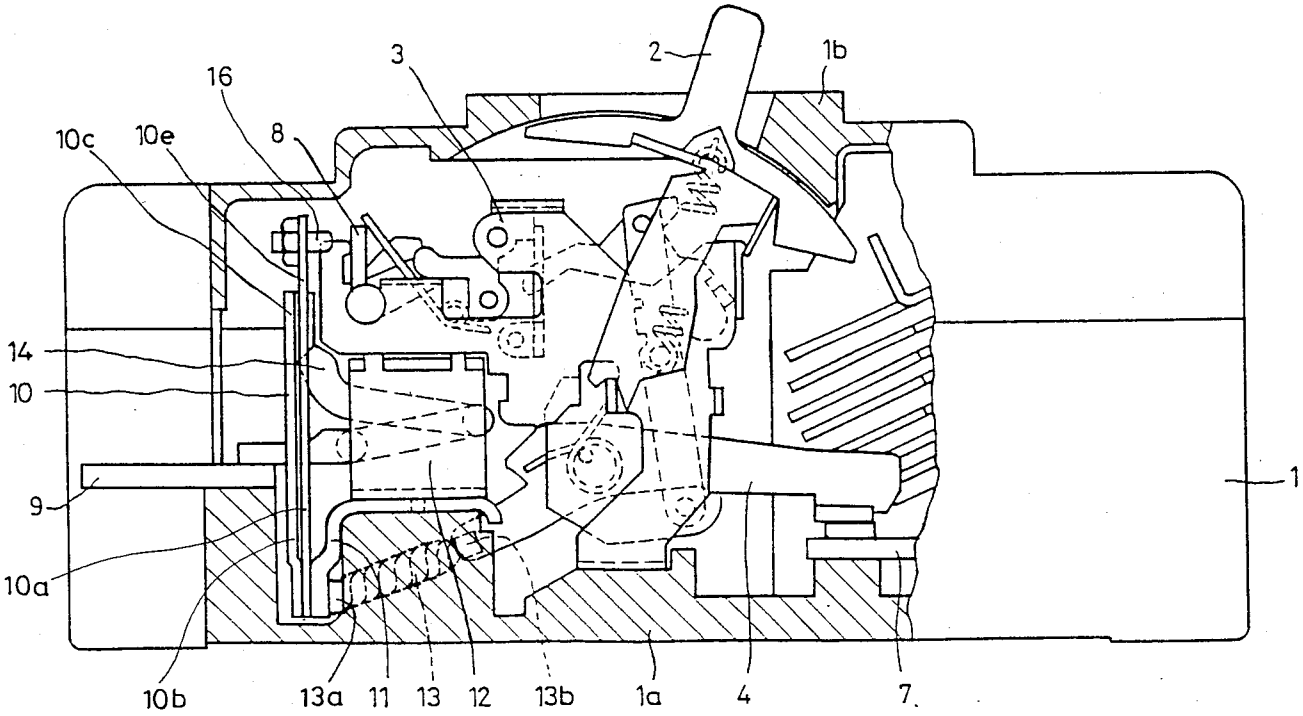
FIG. 4 (Prior Art)
FIG. 4 is the cross-sectional view showing the configuration of the conventional circuit breaker in the prior art.
Figure 5:
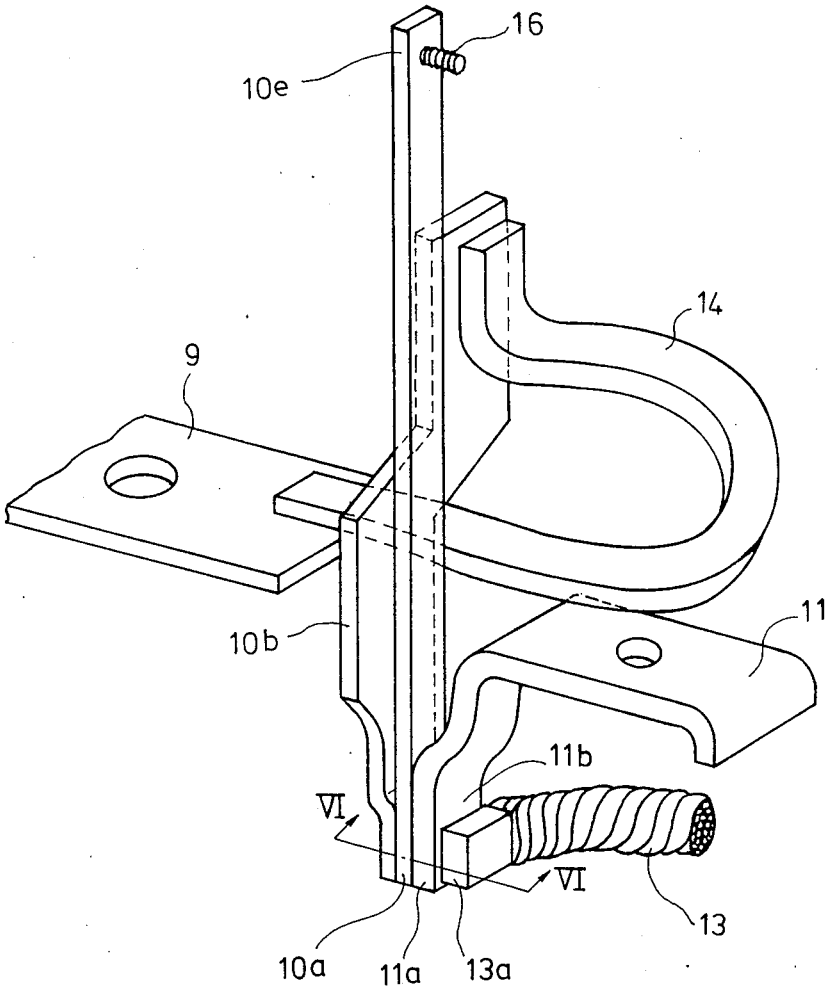
FIG. 5 (Prior Art)
FIG. 5 is a perspective view of the thermal tripping device of the conventional circuit breaker in the prior art.
Figure 6:
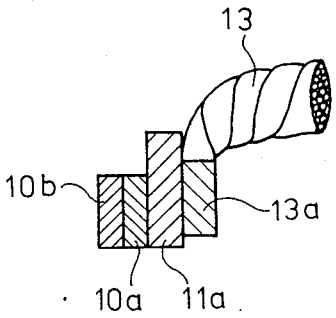
FIG. 6 (Prior Art)
FIG. 6 is a cross-sectional view by a line VI—VI of the thermal tripping device as shown in FIG. 5.
Figure 7:
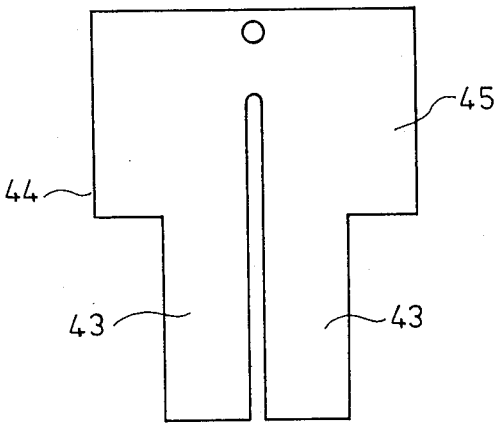
FIG. 7 (Prior Art)
FIG. 7 is a plan view of the bimetal portion of a circuit breaker known in the prior art.

The detailed configuration of the junction part 11*a* is shown in FIG. 2 and a cross-sectional view at a line III—III is shown in FIG. 3. An arm 11*c* is formed at the junction part 11*a* of the holding member 11 as shown in FIG. 2. The end 13*a* of the flexible copper wire 13 is fixed, e.g., by brazing on a surface 11*b* of the arm 11*c*,.

When an over current flows through the flexible copper wire 13 and the arm 11*c*, heat is generated in the arm 11*c* since the arm 11*c* is made of a metal such as chrome-copper (CrCu), brass, steel or like material having a higher resistance than copper. The generated heat is conducted to the bimetal element 10*a* through the junction part 11*a*. Furthermore, the bimetal element 10*a* is also heated by the heater 10*b*. As a result, the bimetal element 10*a* deflects sufficiently. In the embodiment in accordance with the present invention, the arm 11*c* acts as an auxiliary heater. When a holding part which is fixed on the junction part 11*a* of the bimetal element 10*a* is heated, the bimetal bends in proximity to the holding part. Hence, the free end 10*e* of the bimetal element 10*a* moves. Therefore the bimetal element definitely moves the trip bar 8 and the circuit breaker is rapidly tripped.

What is claimed is:

1. A circuit breaker, comprising:

a thermal tripping device having a bimetal element and a heater, said heater being juxtaposed adjacent said bimetal element to heat the same primarily by radiated heat;

a holding member for holding said bimetal element and said heater at respective first end parts thereof;

arm means, thermally and electrically connected to said holding member, for generating heat by providing electrical resistance to flowing of over-current therethrough and for thermally conducting said generated heat to said first end part of said bimetal element; and a flexible copper wire connected to said arm for flowing current thereto.

2. A circuit breaker in accordance with claim 1, wherein:

said arm means comprises a bent portion of said holding member.

3. A circuit breaker in accordance with claim 1, wherein:

a terminal part of said flexible copper wire is formed to have a rectangular shape that is brazed to said arm means.

4. A circuit breaker in accordance with claim 1, wherein:

said arm means comprises a material selected from a group of materials including CrCu, Bs and steel.

* * * * *

UNITED STATES PATENT AND TRADEMARK OFFICE

CERTIFICATE OF CORRECTION

PATENT NO. : 4,695,814

DATED : September 22, 1987

INVENTOR(S) : Yoshiaki MATSUMOTO et al.

It is certified that error appears in the above-identified patent and that said Letters Patent is hereby corrected as shown below:

On the title page, items [19] and [75]:

Please correct the first listed inventor's name as follows:

-- Yoshiaki Matsumoto --.

Signed and Sealed this

Twenty-fifth Day of May, 1993

Michael K. Kirk

*Attest:*

MICHAEL K. KIRK

*Attesting Officer*

*Acting Commissioner of Patents and Trademarks*